United States Patent [19]

Weiner

[11] 4,350,388

[45] Sep. 21, 1982

[54] BACKRESTS

[75] Inventor: Hans Weiner, Täby, Sweden

[73] Assignee: Spina-Trac AB, Stockholm, Sweden

[21] Appl. No.: 948,285

[22] Filed: Oct. 3, 1978

Related U.S. Application Data

[63] Continuation-in-part of Ser. No. 817,008, Jul. 19, 1977, abandoned.

[30] Foreign Application Priority Data

May 23, 1978 [SE] Sweden ..... 7805844

[51] Int. Cl.[3] ..... A47C 7/46

[52] U.S. Cl. ..... 297/284

[58] Field of Search ..... 5/191, 194, 198; 190/58 B; 297/284

[56] References Cited

U.S. PATENT DOCUMENTS

| | | | |
|---|---|---|---|
| 2,118,323 | 5/1938 | Murphy | 190/58 B |
| 2,756,809 | 7/1956 | Endresen | 297/284 |
| 2,843,195 | 7/1958 | Barvaeus | 297/284 |
| 2,894,565 | 7/1959 | Conner | 297/284 |
| 3,642,319 | 2/1972 | Berchicci | 297/284 |
| 3,663,055 | 5/1972 | Gale | 297/284 |
| 3,762,769 | 10/1973 | Poschl | 297/284 |
| 3,990,742 | 11/1976 | Glass | 297/284 |

*Primary Examiner*—Roy D. Frazier

*Attorney, Agent, or Firm*—James C. Wray

[57] ABSTRACT

A chair backrest having a rigid rectangular base plate and a flexible back support member attached to but movable relative to the base plate, and a spacer between the base plate and the support member, which spacer is movable to adjust the contour of the support member, cooperating locking members being provided on the base plate and spacer to lock the spacer in a number of chosen positions.

13 Claims, 19 Drawing Figures

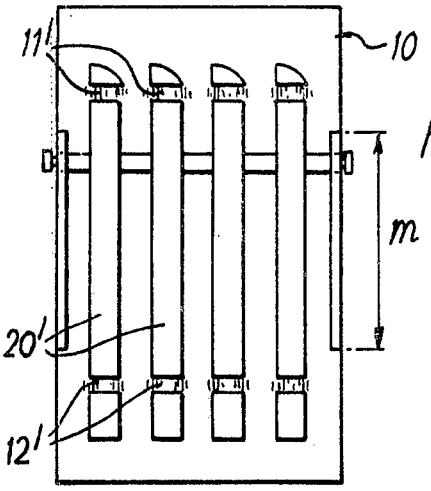
FIG. 4
FIG. 7A
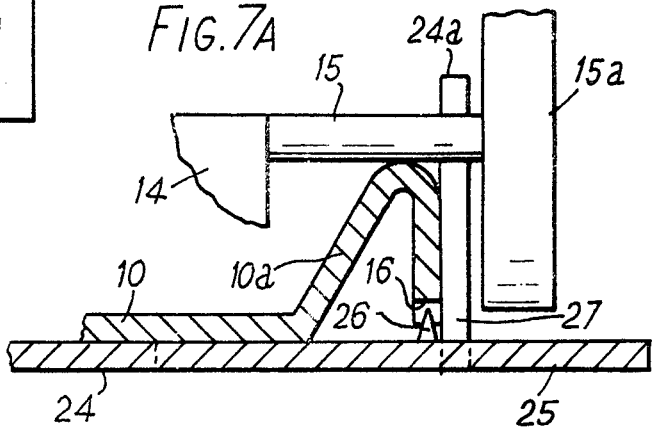
FIG. 8
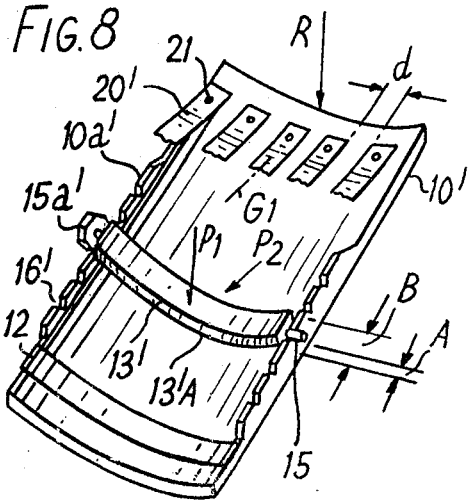
FIG. 9
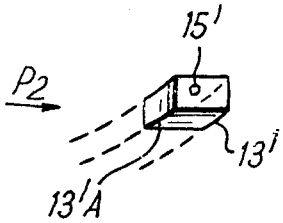

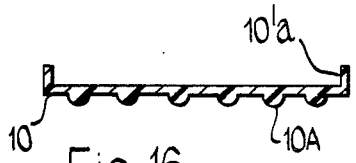
Fig. 16
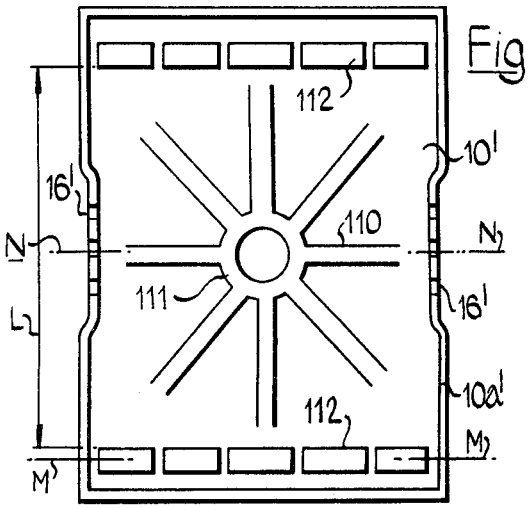
Fig. 17
Fig. 18
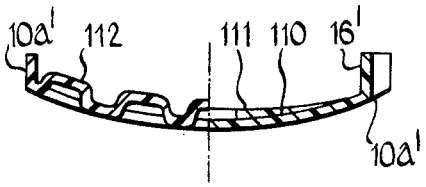

BACKRESTS

This is a continuation-in-part of co-pending application Ser. No. 817,008, filed July 19, 1977, now abandoned.

BACKGROUND OF THE INVENTION

1. Field of the Invention

The present invention relates to backrests with adjustable curvature for furniture such as chairs and beds.

2. Description of the Prior Art

Making backrests for furniture adjustable in such a way that either the height of the backrest over the seating surface or its slope towards the latter can be modified, is well known.

SUMMARY OF THE INVENTION

An object of the present invention is to obtain a backrest whose profile, i.e. form, can be altered or adjusted within certain limits. This means that instead of or in addition to the above-mentioned conventional adjustments, anyone can also choose the most suitable contour. This possibility would be especially welcome to people who suffer from back complaints and the like, who require support in particular in the sacral and lumbar region.

The backrest according to another object of the invention can be manufactured, as an integral component of a chair, i.e. so that it has a base plate which is included in the construction of the chair, or as an addition, which is fixed to or only laid against a normal fixed or adjustable backrest in a conventional chair. People with back complaints can also take backrests adjusted to their needs with them in means of transport.

According to another object of the invention the profile of the backrest, i.e. the profile of the support member, which is preferably made of some suitable plastic material such as soft PVC or the like, can be adjusted primarily because the position of its "top", i.e. the greatest distance from the base plate, is selected by means of displacement of a distance member.

BRIEF DESCRIPTION OF THE DRAWING

FIG. 4 is a plan view of a third embodiment;

FIG. 7A shows the parts of FIGS. 6 and 7 assembled together.

FIG. 8 is a perspective view of a fourth embodiment;

FIG. 9 shows the mounting of the shafts on the distance member of the backrest of FIG. 8;

FIG. 16 is a transverse cross-section of a possible construction for the base plate;

FIG. 17 shows a further possible construction for the base plate; and

FIG. 18 is a transverse sectional view of the base plate shown in FIG. 17.

DESCRIPTION OF THE PREFERRED EMBODIMENTS

Figure 1:
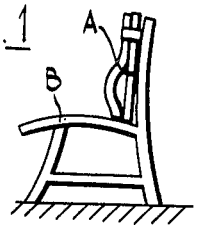
FIG. 1 shows diagrammatically the arrangement of a loose backrest according to the invention on a conventional chair.

FIG. 1 shows how a backrest A according to the present invention can be placed against the conventional backrest of a chair B. The backrest A can easily be built as an integral component of chair B.

Figure 2:
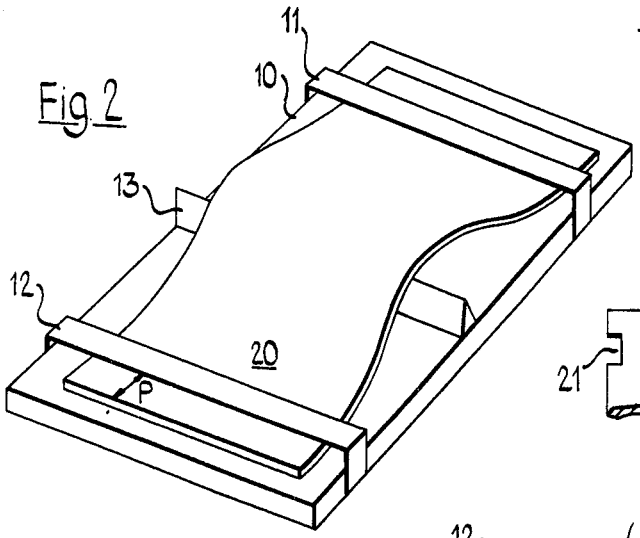
FIG. 2 is a perspective view of a first embodiment of the backrest according to the invention.

In the embodiment shown in FIG. 2, the backrest comprises a rigid base plate 10, e.g. made of metal, wood or hard plastic. On this base plate 10 there is a support member 20 positioned by means of two straps 11, 12, which form the support member's two connection positions. The support member consists of a sheet of pliable plastic, which is loosely inserted under straps 11, 12. Between base plate 10 and support member 20, in the space between straps 11 and 12, there is a distance member in the form of a strip 13 having a cross-section in the shape of an isosceles triangle, movably arranged. By moving distance member 13 towards strap 11 or towards strap 12 and/or by turning over distance member 13, the profile of the support member 20 is altered. The small changes which then occur in the length of the part of support member 20 between the two straps are compensated by this member not being fixed to at least one of straps 11, 12. Assuming that support member 20 is nailed to strap 11, continuing compensation movements shown by the double arrow P of strap 12 are possible. However, support member 20 can also, in principle, freely pass under both straps, as shown in the drawing.

Figure 3:
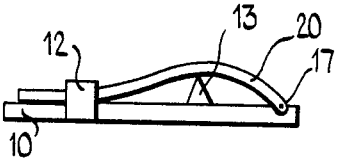
FIG. 3 is a diagrammatic side view of another embodiment.

In the embodiment according to FIG. 2, support member 20 is joined at both connecting positions to base plate 10 in an adjustable and non-pivotable manner. The shape of the profile of support member 20, if distance member 13 is central between straps 11, 12, is symmetrical in relation to this distance member. However, one of the ends of the support member maybe fixed, e.g. according to FIG. 3, by means of a spindle or pivot 17. Then an asymmetrical form is obtained. The whole backrest can be placed on a chair B either with strap 12 or the spindle 17 uppermost. It is obvious that a certain asymmetry is also obtained if straps 11, 12 of FIG. 2 are of different widths.

In the embodiment according to FIG. 4, the support member consists of a number of continuous longitudinal bands 20', of the same material as plate 20. Straps 11 and 12 have been changed to clamp bridges 11' and 12' for the separate bands 20'. As is shown the clamp bridges are integral pressed out strips of the base plate.

Figure 5:
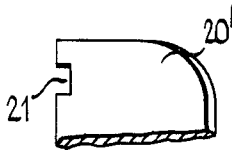
FIG. 5 shows, on a larger scale, a detail of the embodiment in accordance with FIG. 4.

Bands 20' can, according to FIG. 5, be held in a simple manner at one of the connecting positions by their end parts being curved and provided with notches 21, which in principle are of the same width as clamp bridges 11'. Said end parts can consequently be hooked on to the clamp bridges and again easily be removed, e.g. for cleaning purposes.

Figure 6:
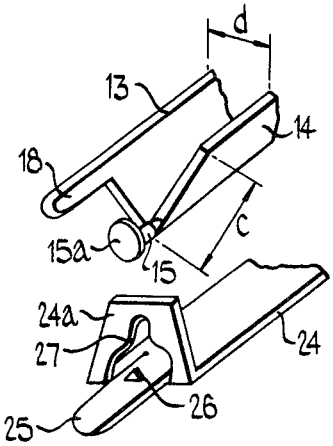
FIG. 6 shows a detail of a preferred form of the distance member and its bearing.

According to FIG. 6, the distance member 13 consists of a narrow, longitudinally continuous strip of, e.g., sheet metal or the like, which is bent to a V-shape with different dimensions c and d, and at both ends is provided with bearing pins 15 for rotatably engaging in brackets. These brackets preferably consist of the turned-up ends of a flat, displaceable, continuous strip 24, e.g. made of a strip metal, under the base plate 10, formed with keyhole-shaped openings 27. The wider parts of the openings, but not the narrower, allow passage of the heads 15*a* of bearing pins 15.

The strip or band 24 is furthermore provided at its ends, in the upwardly-bent parts, with resilient tongues 25, which in turn are provided with abutment members 26 in the form of projections, pins or the like for positioning along the base plate 10.

Figure 7:
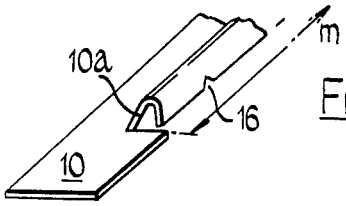
FIG. 7 shows a detail of the base plate with positioning member for the distance member.

This base plate is provided along the edge m (FIG. 4), for the positioning of the distance member and as shown in FIG. 7, with a number of notches 16 for the abutment members 26. If the base plate is made of sheet metal, these notches can be arranged to advantage as an upwardly- and downwardly-folded edge area 10*a*, which at the same time holds the distance member 13 in place laterally.

FIG. 7 shows a piece cut out of the side of the base plate 10 showing that over a length m (FIG. 4) the edge of the base plate is bent. The right hand edge of FIG. 7 is the right hand longitudinal edge of the base plate. A strip 10*a* is pressed out of the base plate near the edge to form an upwardly and downwardly folded part. The downwardly folded part is provided with notches 16.

The heads 15*a* of the distance member 13 (FIG. 6) are entered into the lower larger ends of the openings 27 and moved up to bring the pins 15 into the narrow upper ends of the openings 27. Thus the member 13 is attached to the bracket 24. The bracket then is presented to the base plate 10 and the members 26 enter a pair of opposed notches 16.

The member 13 has projections 18 to be held by the fingers when positioning the member 13.

According to FIG. 8, a rigid base plate 10' is curved transversely and has a radius of curvature R. The support member consists of a plurality of resilient bands 20' spaced apart a distance d as in FIG. 4, fixed at set of adjacent ends by bolts 21 to the base plate and passing at their other ends freely under a strap 12. The distance member is defined by a doubly curved rod 13' having a rectangular cross-section. The rod 13' is curved with the same radius R as the base plate 10' as well in the direction of the arrow $P_1$, perpendicular to the long side (which has a length B) of the cross-section, as in the direction of the arrow $P_2$, perpendicular to the short side (which has a length A) of the cross-section. The edges of the rod 13', such as edge 13'A, are therefore defined by the intersection line of two cylinders having both the radius R and mutually perpendicular axes. From the side faces of the rod 13' protrude short shafts 15' on which manipulating knobs 15*a'* are mounted (only one knob 15*a'* is shown for clarity). Along the rectilinear longitudinal sides of the base plate 10' protruding edges 10*a'* with a plurality of recesses 16' for the shafts 15' are arranged.

By turning the knobs 15*a'*, one or the other of the distances A, B is chosen as the height dimension of the distance member 13'. The rod 13' will however in both chosen positions along its entire underface rest on the base plate 10', and the bands 20' in their turn will be sustained by a concavely curved face of the distance member, so that a saddle-shaped back rest surface in the manner of a car seat is obtained.

The back of the curved base plate 10' fits in its turn better in a conventional, also transversely curved, back rest.

The resilience of the bands 20' presses the distance member 13' with its shafts 15' into a chosen pair of recesses 16'. This resilience can however easily be overcome for re-setting the distance member 13' in another pair of recesses 16'.

There is in practice no need for arranging a particular stop to prevent the distance member from being turned "upside down", i.e. with a concave face towards the base plate 10', because such a position is so obviously incorrect and is not useful, that it immediately would be abandoned if set by mistake. According to FIG. 9, the shafts 15' are not attached in the geometrical center of the rectangular end faces of the rod 13', but at equal distances from three sides to the height of the centres of the recesses 16' above the upper face of the base plate 10'.

Figure 10:
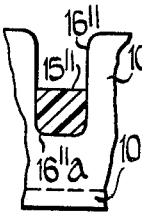
FIG. 10 shows an alternative construction for retaining the distance member on the base plate.

It will be however realised that in principle the shafts 15' can be attached even in the geometrical center of a rectangular end face of the rod 13', the recesses 16' in accordance with FIG. 10 being provided with elongated edges 16'' extending at right angles to the base plate 10'. The shaft 15 will then either rest close to the bottom 16''*a* of the recess which has the shape of an elongated slot, or at some distance above this bottom position.

It will be further understood, in this context, that a double-curved distance member doesn't necessarily need to be associated with a transversely curved base plate as 10', because according to FIG. 10 sufficiently high protruding edges 10*a'* can support such a distance member in any desired distance above a plane base plate such as 10. The shafts 15'' and the recesses 16'' may then, and also in any other case, according to FIG. 10 have other than circular cross-section to better secure the chosen position of the distance member. This position is changed by the distance member 13' being lifted out of the respective pair of recesses or slits 16'', in the same way as when moving it into another pair of recesses or slits, turned with 90°, and reset.

Figure 11:
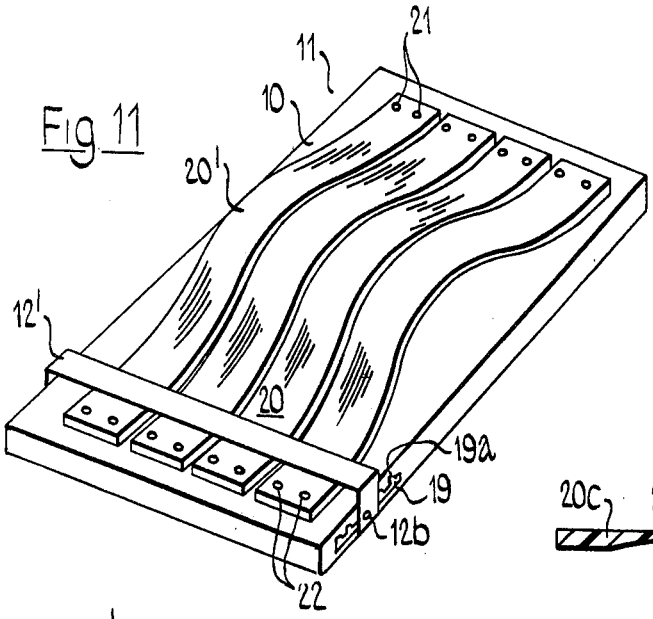
FIG. 11 is a perspective view of a fifth embodiment.
Figure 13:
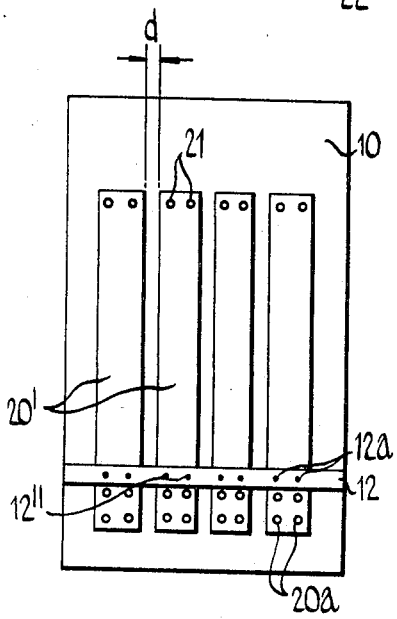
FIG. 13 is a plan view of a seventh embodiment.
Figure 12:
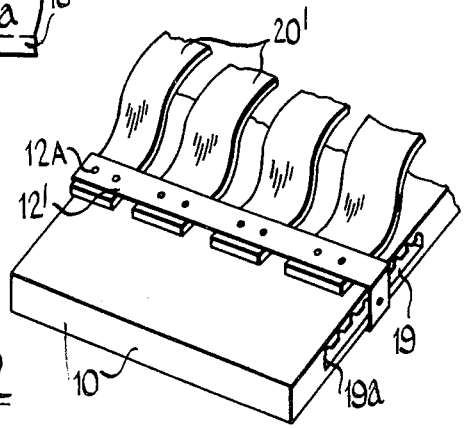
FIG. 12 shows a portion of a sixth embodiment.

In FIG. 11 a base plate 10 is shown to which a plurality of resilient bands 20' are fixedly attached at both ends by means of bolts 21 and 22. The length of the bands 20 between the bolts 21 and 22 is longer than the distance between these bolts on the base plate 10, so that a convex curvature of the bands 20' is obtained without any particular distance element. To make this curvature adjustable, a strap 12' overbridging the bands 20' is movable with the aid of bent end portions provided with inwardly protruding engagement means 12*b*, in longitudinal grooves 19 in the side edges of the base plate 10 where a plurality of recesses 19*a* are provided to receive the inwardly protruding engagement means 12*b*. Alternatively, according to FIG. 12, the bands 20' can be fixed by bolts 12A to the strap 12' or according to FIG. 13, the bands 20' may have a plurality of openings 20*a*, longitudinally spaced apart, through which bolts 22' (FIG. 14) can be passed and anchored in corresponding openings in the base plate 10 and/or in the fixed strap 12.

Figure 14:
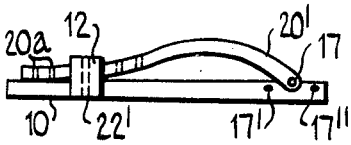
FIG. 14 is a diagrammatic side view of an eighth embodiment.

According to FIG. 14, the bands 20' can be attached to the base plate 10' rotatably, as shown at 17, and several positions such as 17', 17'' may be chosen to obtain various curvatures. At the other end, either also a rotatable attachment, or an attachment with face-to-face contact, as shown in FIG. 14, may be chosen.

Figure 15:
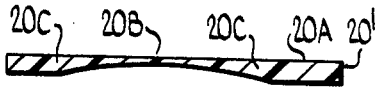
FIG. 15 is a longitudinal sectional view of the support member of the embodiments shown in FIGS. 11 to 14.

According to FIG. 15, a support member 20A may in the embodiments according to FIGS. 11 to 14 have in the longitudinal cross-section a zone 20B with greater resiliency than in the neighbouring zones 20C. The top of the curvature will then always lie in the zone 20B.

Preferably, among the several possible setting positions for a support member, one is provided where the support member along its whole length adheres to the base plate 10, i.e. where the distances between the attachment positions on the support member and on the base plate are equal. This is the transport and storing position of the back rest, shown in FIG. 13.

The base plate in the embodiments according to FIGS. 11 to 14 can be made flexible in the transverse direction only, to adapt itself to the transverse curvature e.g. of an underlying conventional back rest. This flexibility in the transverse direction only may be achieved e.g. by making the base plate of an at least partially resilient material and either giving it in transverse cross-section a profile analogous to that shown in FIG. 15, or providing it in accordance with FIG. 16 with longitudinal stiffening ribs 10A counter-acting the inherent resiliency in the longitudinal direction. The strap 12 is then also made of resilient material.

In FIG. 17 a base plate 10' for the back rest according to the present invention is shown in plan view, and in FIG. 18, in the left hand part thereof, in a section along the line M—M, and in the right hand part thereof in a section along the line N—N in FIG. 17.

The base plate 10' is made of non-resilient plastic and reinforced by ribs such as 110 which radiate from a central hub 111 and at their free ends merge into the concave upper face of the base plate. Near both transversal ends of the base plate a series of loops or straps 112 is arranged under which bands 20' (FIG. 8) can be slid. Along the whole periphery of the base plate which at the longitudinally central part is somewhat drawn-in, an upturned edge 10' is arranged.

The base plate according to FIG. 17 can be used as well for back rests with a distance member, as for back rests without a distance member. For the former case, a series of recesses or notches 16' is arranged in the longitudinally central part of the upturned edge 10a' for the short shafts 15' (FIG. 17). The manipulating knobs 15a' do not protrude out of the periphery of the base plate thanks to the indrawn central area. Bands 20' longer than the mutual distance between the upturned edges at the two shorter sides are slid under the loops or strips 112. Their ends abut then against said upturned edges at the two shorter sides and a curvature of the bands is obtained.

Many variants are possible within the general scope of the invention. For example, the distance member can be of other than the two shown sections and the connection of the support member to the base plate can be formed in a different manner.

I claim:

1. A backrest suitable for use as an addition to chairs, car seats, and the like, comprising a rigid base member in the form of a substantially rectangular base plate having an upper face, two long sides, and two short sides at the ends of the base plate, an inherently elastic, substantially rectangular and curved support member having two long sides and two short sides, the short sides of the support member being adjacent to the ends of the base plate, two connecting means which respectively connect the support member to the base plate at positions adjacent to the ends of the support member, at least one of these connecting means being such as to permit sliding movement of the respective end of the support member relative to the base plate; and a distance member having substantially the same length as the width of the support member and arranged between the base plate and the support member, intermediate their ends, thereby spacing the support member from the base plate between said ends, said distance member being movable lengthwise of the base plate, characterized by the following:

at least one of said connecting means extends transversely over the support member and engages the upper face of the support member at a short distance from an adjacent short side thereof so as to make the support member positively follow and press against the base plate, each long side of the base plate being along its central portion provided with a plurality of notches spaced apart from each other, opposite notches on the two long sides defining a pair of cooperating fixation means; engagement means are provided on the distance member for engagement with any selected pair of cooperating notches, and said engagement means by the combined influence of the inherent elasticity of the support member and of the said engagement of the upper face of the support member are pressed in a selected pair of notches and are releasable therefrom by overcoming the said inherent elasticity, and the support member is held by the distance member in a convex curvature relative to the base member having an apex of curvature where it is supported by said distance member, said apex being adjustable by said distance member, said apex being adjustable longitudinally of the base member by engagement of the said engagement means of the distance member with different pairs of cooperating notches.

2. A backrest according to claim 1, in which the support member comprises a plurality of mutually parallel bands and at least one of said connecting means is in the form of a clamp bridge under which the bands pass.

3. A backrest according to claim 2, in which the bands at one end are provided with notches for hooking to at least one clamp bridge.

4. A back rest according to claim 1, in which the distance member consists of a bearer having a constant non-circular cross-section, and is adjustable to at least two different heights by having in cross-section different dimensions in at least two different widthwise directions.

5. A backrest according to claim 4, in which the distance member consists of a narrow strip of stiff material which is bent in cross-section to a V-shaped profile and is at both ends provided with bearing pins constituting said notch engagement means.

6. A backrest as claimed in claim 4, wherein the distance member has a rectangular cross-section which has two long and two short sides and is in its longitudinal direction on at least one face curved perpendicularly to the short sides and on at least one other face is curved perpendicularly to the long sides of the cross-section and is arranged to support the support member by a concavely curved face, said support member being defined by a plurality of mutually parallel and spaced apart resilient bands which are adapted to adopt, by the cooperation of the connecting means and the distance member, a saddle-shaped curvature relative to the base plate, the extent of which curvature is adjustable by the distance member being turned with the shorter or the longer side of its cross-section perpendicularly to the base plate, and the apex of which curvature is shiftable in the direction of the long sides in steps corresponding to the spacing between adjacent pairs of notches.

7. A backrest according to claim 6, in which the base plate is in the direction of its short sides concavely curved and two adjacent faces of the distance member are convexly curved to the same extent as the base plate is concavely curved, so that the distance member can with any of these two convexly curved faces along its entire length engage the base plate.

8. A backrest according to claim 1, in which the base plate is of hard plastic and the support member consists of a plurality of longitudinal bands of resilient plastic.

9. A backrest according to claim 1, in which the base plate is provided with at least one system of stiffening ribs.

10. A backrest according to claim 1, in which the base plate has in the central region of its two longer sides an indrawn area for accommodating the end portions of the distance member, and said end portions are provided with manipulating elements.

11. A backrest according to claim 1, in which the base plate has upturned edges.

12. A backrest, suitable for use as an addition to chairs, car seats and the like, comprising a rigid, substantially rectangular base plate, a resilient substantially rectangular curved support means superimposed on the base plate and having an exposed face turned away from the base plate, the ends of the support means being adjacent to the respective ends of the base plate, and an elongated distance member having two end portions, the base plate and the support means each having two long sides and two short sides, the long sides being parallel one with another and the short sides being parallel one with another, connecting means located adjacent to the said short sides and holding the support member against the base plate, at least one of these connecting means allowing one end of the support means to move relatively to the base plate in the direction of the long sides, and the distance member having a length approximately corresponding to the length of the short sides of the support means and being interposed between the base plate and the support means intermediate said connecting means and movable in the direction of the long sides, at least one of said connecting means including a transverse part which extends transversely over said support means and engages the exposed face of at least one end of the support means, said at least one connecting means comprising (a) a plurality of notches in each long side of the base member spaced apart from each other and (b) notch engagement means on each end of the said transverse part engageable releasably with said notches under the pressure of the elasticity of the support means whereby said transverse part can be located by any pair of opposed notches in any of a series of predetermined positions longitudinally of the base plate, said support member being held in a convex curvature the apex of which is shiftable lengthwise of the base plate in steps corresponding to the spacing of opposed pairs of notches.

13. A backrest according to claim 12, in which the support member comprises a plurality of mutually parallel bands.

* * * * *

UNITED STATES PATENT AND TRADEMARK OFFICE

CERTIFICATE OF CORRECTION

PATENT NO. 4,350,388

DATED September 21, 1982

INVENTOR(S) : Hans WIENER

It is certified that error appears in the above—identified patent and that said Letters Patent is hereby corrected as shown below:

ON THE TITLE PAGE, ITEM [75] should read

--[75] Inventor: Hans Wiener, Täby, Sweden --.

Signed and Sealed this

Thirtieth Day of August, 1988

*Attest:*

DONALD J. QUIGG

*Attesting Officer*

*Commissioner of Patents and Trademarks*